United States Patent [19]

Kuboshima

[11] Patent Number: 4,543,005

[45] Date of Patent: Sep. 24, 1985

[54] CONTAINER FOR INSTANTANEOUS ADHESIVE HAVING MEANS TO PROTECT BIAS SPRING

[75] Inventor: Yasuyuki Kuboshima, Tokyo, Japan

[73] Assignee: Florex Co., Ltd., Tokyo, Japan

[21] Appl. No.: 557,598

[22] Filed: Dec. 5, 1983

[30] Foreign Application Priority Data

Dec. 14, 1982 [JP] Japan ..... 57-217736

[51] Int. Cl.[4] ..... B43K 1/06; B43K 1/10; B05C 17/00

[52] U.S. Cl. ..... 401/260; 401/180; 401/206; 401/264; 401/273

[58] Field of Search ..... 401/264, 206, 81, 180, 401/273, 260

[56] References Cited

U.S. PATENT DOCUMENTS

| | | | |
|---|---|---|---|
| 363,526 | 5/1887 | Livermore | 401/260 |
| 2,790,984 | 5/1957 | Gilpin | 401/206 X |
| 3,680,968 | 8/1972 | Schwartzman et al. | 401/206 X |
| 3,832,071 | 8/1974 | Chaney | 401/260 |

FOREIGN PATENT DOCUMENTS

| | | | |
|---|---|---|---|
| 552514 | 2/1958 | Canada | 401/264 |
| 823360 | 1/1938 | France | 401/264 |
| 602088 | 5/1948 | United Kingdom | 401/180 |
| 620472 | 3/1949 | United Kingdom | 401/273 |

*Primary Examiner*—Steven A. Bratlie
*Attorney, Agent, or Firm*—Thomas I. Rozsa

[57] ABSTRACT

The invention relates to a container for an instantaneous adhesive and more particularly to an arrangement of a so-called pencil-type container which contains the instantaneous adhesive therein. Through use of the present invention, an appropriate small amount of the instantaneous adhesive can be delivered on a part to be bonded through a nozzle disposed at the upper end of the container by urging the top of the container against the part to be bonded. The container is sealed when not in use through a novel spring mechanism which closes the container urging a nozzle against the opening at the tip of the casing.

7 Claims, 9 Drawing Figures

CONTAINER FOR INSTANTANEOUS ADHESIVE HAVING MEANS TO PROTECT BIAS SPRING

BACKGROUND OF THE INVENTION

1. Field of the Invention

The present invention relates to a container for an instantaneous adhesive, such as glue. Containers for glue have been formed in many shapes, such as a conventional tube or a plastic bottle through which the glue is squeezed. The present invention relates to improvements in bottle type glue containers which provides a more efficient apparatus for dispensing the glue and to assure that the opening will not be clogged by dried adhesive.

2. Description of the Prior Art

The most common type of glue dispenser is a tube which contains the glue therein. The glue is dispensed by squeezing the tube along its length to permit the glue to flow from an opening located in the front. One significant disadvantage of this apparatus is that dried adhesive frequently clogs the opening. Therefore, it is very difficult to dispense the glue subsequent to the first use.

A second type of glue dispensing apparatus is a plastic bottle which contains a nozzle at the front end and an opening surrounding the nozzle through which glue can be dispensed. Since the opening is created by moving an outer casing forward to leave an opening between the casing and the interior nozzle, adhesive frequently comes between the casing and nozzle and serves to clog the opening. Since the bottle tends to be more rigid than the tube, after a portion of glue is used, it becomes more difficult to squeeze the bottle to extract the remaining glue through the now partially clogged hole.

Therefore, the prior art does not provide an effective apparatus for dispensing instantaneous adhesive, such as glue, from a container.

SUMMARY OF THE PRESENT INVENTION

The present invention relates to a container for an instantaneous adhesive and more particularly to an arrangement of a so-called pencil-type container which contains the instantaneous adhesive therein. Through use of the present invention, an appropriate small amount of the instantaneous adhesive can be delivered on a part to be bonded through a nozzle disposed at the upper end of the container by urging the top of the container against the part to be bonded.

Most of the commercially available instantaneous adhesives are cyanoacrylic monomers. A cyanoacrylic monomer instantaneous adhesive is anionically polymerized with an OH anion in a very small amount of water which is found in the air. This polymerization causes instantaneous solidification. The radical polymerization of the monomer proceeds insignificantly slowly under a usual condition for application of the adhesive. However, the effects of heat, light, metals and the like, cause the monomer to initiate radical polymerization during production or storage thereof, resulting in an ineffective adhesive. For this reason, it is important that inert resins, such as polyethylene, be employed as the material of the container for the instantaneous adhesive, as well as most of the components of the container.

A key component of the present invention pencil container is an internal spring which serves to urge an internal nozzle valve against an external casing containing an opening. The spring must be of small size and have a strong resilient force to insure an air-tight abutment between the nozzle valve and the nozzle casing. Current all-plastic containers of the pencil type known in the prior art, which are made of a plastic material, such as polyethylene, are of a large size or of a complicated shape in order to produce the required resilient force. This results in disadvantages in designing and production, and furthermore, results in disadvantages of variation in resilient force with temperature.

It has been discovered, according to the present invention, that if a pencil container for an adhesive contains an internal spring which serves to urge an internal nozzle against an external casing to seal the opening, then the container can be used to effectively dispense adhesive by a force against the nozzle, which serves to counteract the force of the spring. When such force is released, the spring serves to immediately seal the opening between the nozzle and the casing to assure that adhesive will not become polymerized and not clog the opening.

It has further been discovered, according to the present invention, that it is necessary to seal the spring from the adhesive in order to assure that there will be no interaction between the adhesive and the metal of the spring.

It is therefore a primary object of the present invention to provide a container for an instantaneous adhesive which permits the adhesive to be easily dispensed from the container and further provides an efficient means to seal the container so that no adhesive will become polymerized at or near the opening to thereby clog the opening.

It is a further object of the present invention to provide a means to seal the container, which is a novel spring arrangement. In the preferred embodiment, the spring is made of metal. Since the metal will polymerize the instantaneous adhesive, an important feature of the present invention is to provide a means to separate the metal spring from the surrounding instantaneous adhesive within the container.

It is another object of the present invention to provide a container for instantaneous adhesive, wherein a spring made of metal is hermetically enclosed in a bag made of an inert soft material such as polyethylene.

It is yet another object of the present invention to provide a container for an instantaneous adhesive, wherein a spring made of metal is coated with an inert material.

It is a further object of the present invention to provide a container for an instantaneous adhesive, wherein a spring is made of a material such as stainless steel which cannot cause the instantaneous adhesive to be deteriorated.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

Figures 1, 2, 3, 4, 5, 6, 7, 7A, 8:
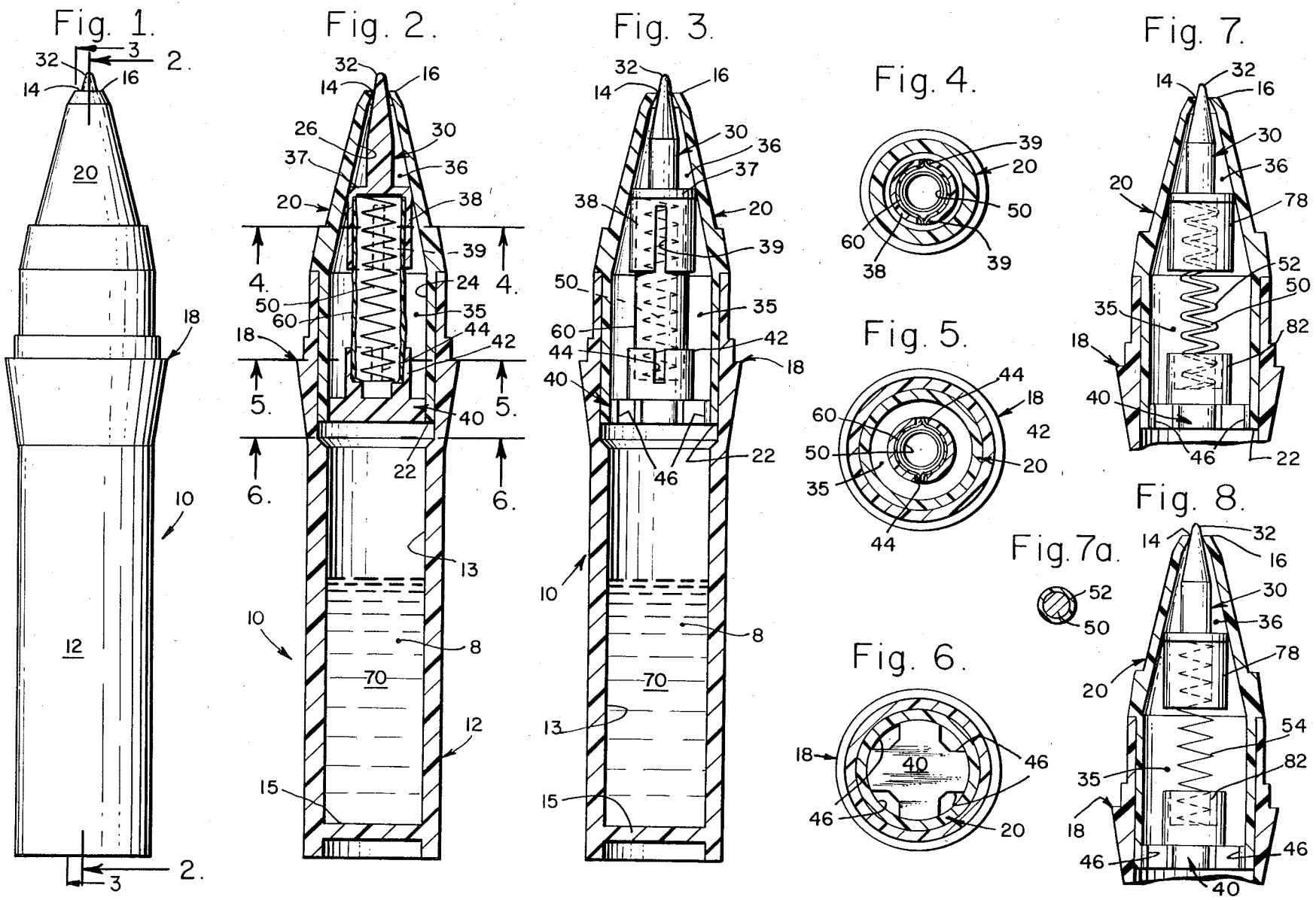
FIG. 1 is a side view of the present invention container for instantaneous adhesive.
FIG. 2 is a cross-sectional view of the present invention, taken along line 2—2 of FIG. 1. This cross-sectional view is taken through the center of the present invention.
FIG. 3 is a cross-sectional view of the present invention, taken along line 3—3 of FIG. 1. This cross-sectional view is off-center to show a side view of the nozzle and of a covering surrounding the spring.
FIG. 4 is a cross-sectional view taken along line 4—4 of FIG. 2.
FIG. 5 is a cross-sectional view taken along line 5—5 of FIG. 2.
FIG. 6 is a cross-sectional view taken along line 6—6 of FIG. 2.
FIG. 7 is a partial cross-sectional view of the nozzle casing and nozzle assembly portion of the present invention, showing an alternative embodiment for the spring arrangement of the present invention.

FIG. 7*a* is a fragmentary cross-sectional view of the metallic spring and the coating on the spring.

FIG. 8 is a partial cross-sectional view of the nozzle casing and nozzle assembly portion of the present invention, showing another alternative embodiment of the spring arrangement of the present invention.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications to one skilled in the art to which the invention pertains are deemed to be within the spirit, scope and contemplation of the invention as further defined in the appended claims.

Reference will now be made to FIGS. 1 through 6 which disclose the preferred embodiment of the present invention. The container is shown at 10 and incorporates within its design a generally cylindrical container body 12. Other shapes for the container body are within the spirit and scope of the present invention. The container for an instantaneous adhesive 10 has an opening 14 adjacent its front end 16. The container 10 is preferably made of plastic material such as polyethylene. A stepped projection 18 is formed around the upper and outer periphery of the body 12 so that a cap (not shown in the Figures) may be fitted on the stepped projection 18 and enclose the upper or front portion of the container 10.

A nozzle casing 20 which is open at its lower end 22 is fixedly inserted into the container body 12 so that the exterior wall 24 of the nozzle casing tightly abuts the upper interior cylindrical wall of the container body 12. The nozzle casing 20 contains the opening 14 at its upper end 16.

Located within the nozzle casing 20 is a nozzle assembly which includes a nozzle valve 30. The tip 32 of the nozzle valve 30 fits within the opening 14 of the nozzle casing 20. The nozzle tip 32 can be retracted from the opening 14. When inserted into the opening 14, the nozzle tip 32 seals the container 10. When the nozzle tip 32 is retracted from the opening 14, the container 10 is in the open position. Therefore, an instantaneous adhesive flow path 36 is defined between the nozzle tip 32 and the interior wall 26 of the nozzle casing 20. A force exerted against the nozzle tip 32 will cause it to retract from the opening 14 and permit instantaneous adhesive to flow out of the opening 14. The nozzle valve 30 has a center projection 37 located at the base of the nozzle tip 32. The center projection 37 is generally circular and abuts the internal wall 26 of the nozzle casing 20. Extending from the center projection 37 is a nozzle skirt 38. The skirt 38 contains two opposed slits 39.

A stopper valve 40 is fixedly inserted into the lower opening 22 of the valve casing 20 to thereby close the lower opening. At the upper part of the stopper 40 there is formed a skirt 42 having two opposed slits 44. The lower outer periphery of the stopper 40 contains a channel 46 through which adhesive can flow. In the preferred embodiment, the container body, the nozzle casing 20, the nozzle 30 and its associated components, and the stopper 40 and its associated components are all made of plastic such as polyethylene.

A spring 50 made of metal is interposed between the nozzle valve 30 and the stopper 40 to always urge the nozzle valve 30 against the inner surface of the opening 14 in the nozzle casing 20. The front portion of the spring 50 is contained within skirt 38 of the nozzle valve 30 while the lower or rear portion of the spring 50 is contained within skirt 42 of the stopper 40. The spring 50 is hermetically sealed by a bag 60. The bag is made of sheets of soft plastic such as polyethylene. The edges of the bag are thermally sealed. The front end of bag 60 is engaged in slits 39 of the skirt 38 of nozzle valve 30. The lower or rear end of bag 60 is engaged in slits 44 of the skirt 42 of stopper 40. Therefore the thermally sealed edges on both sides of the bag 60 are engaged in the slits and thus set in place.

The instantaneous adhesive 70 is contained within the chamber 8 defined by the interior wall 13 of container body 12, a lower transverse wall 15 of the container body 12 and the stopper 40. In using the present invention 10, the nozzle tip 32 is depressed on a part to be bonded. This force against the nozzle tip 32 counteracts the force of the spring 50, whereupon a space is opened between the nozzle valve 30 and the opening 14 of the nozzle casing 10. Thus, the instantaneous adhesive 70 is permitted to flow out through the channel 46 in the stopper 40, in the space between the bag 60 and nozzle casing wall 26, between the opening now achieved between the center projection 37 and casing wall 26, and in the space 36 between the nozzle valve 30 and casing wall 26, and out opening 14. The flexible bag 60 compresses with the spring 50. Since the metal spring 50 is hermetically sealed inside bag 60, it will not come in contact with the instantaneous adhesive 70. Therefore, the instantaneous adhesive 70 will not be deteriorated from contact with the metal spring 50 during storage or use.

One alternative embodiment of the present invention is shown in FIGS. 7 and 7*a*. In this embodiment, the spring 50 is coated with an inert plastic material such as polyethylene. The polyethylene coating 52 serves to seal the spring 50 from the surrounding instantaneous adhesive 70. The coating can be achieved by known methods such as vapor deposition or immersion. Therefore, the bag 60 can be eliminated. Since the bag 60 is eliminated, the slits 39 in skirt 38 and the slits 44 in skirt 42 are also eliminated. Therefore, skirt 38 is renumbered as 78 to show a skirt without slits. Similarly, skirt 42 is renumbered to 82 to show a skirt without slits. In all other aspects, this second embodiment is the same as the first embodiment disclosed in FIGS. 1 through 6.

Another alternative embodiment of the present invention is shown in FIG. 8. In this embodiment, a different type of spring 54 is used. The spring 54 is made of anti-corrosive metal or alloy. One example of such metal is stainless steel. Other examples of anti-corrosive metals which can be used are chromium, nickel, titanium, molybdenum, etc., either alone or in an alloy combination. The anti-corrosive metal protects it from reacting with the instantaneous adhesive 70 and therefore no bag 60 is needed and no polyethylene coating 52 is needed. Once again, the bag 60 and the slits 39 and 44 are eliminated. In all other aspects, this third embodiment is the same as the first embodiment disclosed in FIGS. 1 through 6.

One example of the instantaneous adhesive that can be used with the present invention is cyanoacrylic monomers.

Described in broader terms, the present invention is a container for an instantaneous adhesive comprising a container body having an internal instantaneous adhesive containing chamber therein which is open at the forward end of the container body, and a nozzle casing fixedly inserted into the open end of said container body such that the base of the nozzle casing extends into the container body and the forward end of the nozzle casing forms the tip of the container. The nozzle casing contains an opening at its tip. The container further comprises a nozzle assembly fixedly inserted into said nozzle casing. The nozzle assembly further comprises a nozzle valve whose tip is retractably inserted into said opening in said nozzle casing, a stopper member located adjacent the lowermost portion of said nozzle casing, and a metallic spring interposed between said nozzle valve and said stopper. The stopper member further contains channels to permit instantaneous adhesive to flow from the internal chamber in the container body to the nozzle casing. Finally, there is a sealing means used to separate said metallic spring from the interior surrounding space inside the nozzle casing and to prevent chemical interaction between the spring and the instantaneous adhesive.

As described above, according to the present invention, since a metallic spring is used, it can be of small size and can produce a sufficient resilient force to keep the container in the sealed position when no counteracting force is exerted against the nozzle tip. Since the instantaneous adhesive will not be polymerized or deteriorated, the container is good for long use. Since the opening 14 is immediately sealed when the counteracting force is removed, no polymerization of instantaneous adhesive will occur at the opening 14 and therefore the opening 14 will not become clogged over time. Therefore, this container 10 can be used many times over a long period, thereby providing a considerably practical pencil-type container for instantaneous adhesives.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might by embodied or operated.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A container for an instantaneous adhesive comprising:

a. a container body having an internal instantaneous adhesive containing chamber therein which is open at the forward end of the container body;

b. a nozzle casing fixedly inserted into the open end of said container body such that the base of the nozzle casing extends into the container body and the forward end of the nozzle casing forms the tip of the container;

c. said nozzle casing comprising an inner wall and an outer wall;

d. said nozzle casing containing an opening at its tip;

e. a nozzle assembly fixedly inserted into said nozzle casing;

f. said nozzle assembly further comprising a nozzle valve whose tip is retractably inserted into said opening in said nozzle casing, a center projection member located at the base of the nozzle valve and extending transversely thereto, a stopper member located adjacent the lowermost portion of said nozzle casing, and a metallic spring interposed between the center projection member and the stopper member;

g. the edge of said center projection member abutting the internal wall of said nozzle casing when said nozzle valve is in the closed position;

h. said stopper member further containing channels to permit instantaneous adhesive to flow from the internal chamber in the container body to the nozzle casing;

i. a first skirt member located adjacent the base of said nozzle valve, extending from the edge of said center projection member, and extending away from the top of the nozzle valve so as to enclose the upper portion of said metallic spring;

j. said first skirt member further containing a pair of oppositely disposed slits;

k. said stopper member containing a second skirt member located above the stopper member and extending toward said first skirt member so as to enclose the lower portion of said metallic spring;

l. said second skirt member containing a pair of oppositely disposed slits;

m. a gap located between said first skirt member and said second skirt member;

n. sealing means used to separate said metallic spring from the interior surrounding space inside the nozzle casing and to prevent the chemical interaction between the metallic spring and the instantaneous adhesive; and o. said sealing means comprising a flexible bag surrounding and hermetically sealing said metallic spring and affixed at its ends to a respective first skirt member and second skirt member at the location of the oppositely disposed slits in each skirt member.

2. The invention as defined in claim 1 wherein said instantaneous adhesive is a cyanoacrylic monomer.

3. The invention as defined in claim 1 wherein said container body is cylindrical.

4. A container for an instantaneous adhesive comprising:

a. a container body having an internal instantaneous adhesive containing chamber therein which is open at the forward end of the container body;

b. a nozzle casing fixedly inserted into the open end of said container body such that the base of the nozzle casing extends into the container body and the forward end of the nozzle casing forms the tip of the container;

c. said nozzle casing comprising an inner wall and an outer wall;

d. said nozzle casing containing an opening at its tip;

e. a nozzle assembly fixedly inserted into said nozzle casing;

f. said nozzle assembly further comprising a nozzle valve whose tip is retractably inserted into said opening in said nozzle casing, a center projection member located at the base of the nozzle valve and extending transversely thereto, a stopper member located adjacent the lowermost portion of said nozzle casing, and a metallic spring interposed between the center projection member and the stopper member;

g. the edge of said center projection member abutting the internal wall of said nozzle casing when said nozzle valve is in the closed position;

h. said stopper member further containing channels to permit instantaneous adhesive to flow from the internal chamber in the container body to the nozzle casing;

i. a first skirt member located adjacent the base of said nozzle valve, extending from the edge of said center projection member, and extending away from the top of the nozzle valve so as to enclose the upper portion of said metallic spring;

j. said stopper member containing a second skirt member located above the stopper member and extending toward said first skirt member so as to enclose the lower portion of said metallic spring;

k. a gap located between said first skirt member and said second skirt member; and l. said metallic spring being coated with a material which is resistant to the instantaneous adhesive contained within the container.

5. The invention as defined in claim 4 wherein said metallic spring is made of stainless steel.

6. The invention as defined in claim 4 wherein said instantaneous adhesive is a cyanoacrylic monomer.

7. The invention as defined in claim 4 wherein said container body is cylindrical.

* * * * *